US007066723B2

(12) United States Patent
Joo

(10) Patent No.: US 7,066,723 B2
(45) Date of Patent: Jun. 27, 2006

(54) SCROLL COMPRESSOR HAVING REVERSION PREVENTIVE DEVICE

(75) Inventor: Young-Se Joo, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/386,494

(22) Filed: Mar. 13, 2003

(65) Prior Publication Data

US 2003/0175139 A1 Sep. 18, 2003

(30) Foreign Application Priority Data

Mar. 14, 2002 (KR) ..... 10-2002-0013911

(51) Int. Cl.
*F04C 18/00* (2006.01)
*F03C 2/00* (2006.01)

(52) U.S. Cl. ..... 418/55.3; 418/55.1; 464/102

(58) Field of Classification Search ..... 418/55.1–55.6, 418/57; 464/102

See application file for complete search history.

(56) References Cited

U.S. PATENT DOCUMENTS 5,071,329 A * 12/1991 Sano et al. ..... 418/55.3
5,403,172 A * 4/1995 Blass et al. ..... 418/55.3
5,496,157 A 3/1996 Shoulders et al.
5,842,845 A * 12/1998 Kawano et al. ..... 418/55.3

FOREIGN PATENT DOCUMENTS

JP 03043690 A * 2/1991
JP 03064685 A * 3/1991
JP 04132888 A * 5/1992
JP 05223068 A * 8/1993
JP 05231348 A * 9/1993

* cited by examiner

*Primary Examiner*—Theresa Trieu
(74) *Attorney, Agent, or Firm*—Birch, Stewart, Kolasch & Birch, LLP

(57) ABSTRACT

In a scroll compressor, by including an oldhams ring arranged between a main frame and an orbiting scroll and having a first and a second oldhams ring keys formed at the top and bottom surfaces so as to be inserted into a first and a second key grooves formed at the orbiting scroll and the main frame respectively; and a reversion preventive unit installed at the second key groove formed at the main frame in order to prevent the reverse operation of the orbiting scroll by stopping the movement of the second oldhams ring key in the reverse operation of the orbiting scroll, it is possible to prevent wrong vibration and noise occurrence of the compressor, and accordingly reliability of the compressor can be improved.

14 Claims, 6 Drawing Sheets

SCROLL COMPRESSOR HAVING REVERSION PREVENTIVE DEVICE

This nonprovisional application claims priority under 35 U.S.C. §119(a) on Patent Application No(s). 2002-0013911 filed in KOREA on Mar. 14, 2002, which is (are) herein incorporated by ref reference.

BACKGROUND OF THE INVENTION

1. Field of the Invention

The present invention relates to a scroll compressor, and in particular to a scroll compressor having a reversion preventive device which is capable of preventing a compressor from being operated in a reverse direction of a direction for compressing a fluid.

2. Description of the Prior Art

In general, there are various types of compressors according to compression methods, among them a scroll compressor is mainly used for an air conditioner required to have a small size and light weight.

FIG. 1 is a sectional view illustrating the conventional scroll compressor.

The conventional scroll compressor includes a casing 106 in which a suction pipe 102 for sucking a fluid is connected, a discharge pipe 104 for discharging a compressed fluid is connected and having a certain sealed space; a driving unit 108 arranged at the lower portion of the casing 106 and generating a driving force; and a compressing unit 110 arranged at the upper portion of the casing 106, connected to the driving unit 108 through a rotational shaft 112, compressing the fluid sucked into the suction pipe 102 and discharging the fluid through the discharge pipe 104 according to the rotation of the rotational shaft 112.

A main frame 114 is installed at the upper portion of the casing 106 in order to support the upper portion of the rotational shaft 112 rotatively and support the compressing unit 110, and a lower frame 116 is installed at the lower portion of the casing 106 in order to support the lower portion of the rotational shaft 112 rotatively.

The driving unit 108 includes a stator 122 fixed in the circumferential direction of the casing 106; and a rotor 124 arranged at the inner circumference of the stator 122 and fixed to the rotational shaft 112. When power is applied to the stator 122, the rotor 124 is rotated by the mutual operation of the stator 122 and the rotor 124, and accordingly the rotational shaft 112 is rotated.

The compressing unit 110 includes a fixed scroll 128 having an involute-shaped fixed wrap 126 and fixed to the upper portion of the casing 106; and an orbiting scroll 132 having an involute-shaped orbiting wrap 130 corresponded to the fixed wrap 126 so as to have a certain compression space 118 therebetween, supported by the main frame 114 and performing an orbiting operation in the rotation of the rotational shaft 112.

A discharge hole 136 is formed at the center of the fixed scroll 128 in order to discharge the fluid compressed by the mutual operation of the fixed wrap 126 and the orbiting wrap 130, and a check valve 138 is installed at the upper portion of the discharge hole 136 in order to prevent the discharge fluid from being flowed backward.

An oldhams ring 150 is installed between the orbiting scroll 132 and the main frame 114 in order to prevent the orbiting scroll 132 from being rotated, and a separating panel 120 is installed at the top surface of the fixed scroll 128 in order to divide the inner space of the casing 106 into a lower pressure side and a high pressure side.

In the above-described conventional scroll compressor, when power is applied to the stator 122, the rotor 124 is rotated by the mutual operation of the stator 122 and the rotor 124, and the rotational shaft 112 fixed to the rotor 124 is rotated in the forward direction. Then, according to the rotation of the rotational shaft 112, the orbiting scroll 132 performs the orbiting operation, compresses the fluid sucked through the suction pipe 102 and discharges it through the discharge pipe 104 by the mutual operation with the fixed scroll 128.

Herein, it is possible to prevent the fluid discharged to the high pressure side through the discharge hole 136 from being flowed backward in the low pressure side by the check valve 138 installed at the discharge hole 136.

However, in the conventional scroll compressor, when a single-phase motor is used as a driving unit for generating a rotational force, if a load occurred in the operation is greater than a motor torque, a rotational force of the motor may be reduced, even worse the motor may be rotated in the backward direction, in that case vibration and noise may occur due to the wrong operation, and accordingly reliability of the compressor may be lowered.

In addition, when a three-phase motor is used as a driving unit for generating a rotational force, if the wrong connection of the motor occurs, the motor may be rotated in the backward direction, in that case vibration and noise may occur due to the wrong operation, and accordingly reliability of the compressor may be lowered.

SUMMARY OF THE INVENTION

In order to solve the above-mentioned problem, it is an object of the present invention to provide a scroll compressor having a reversion preventive device which is capable of improving reliability of a compressor by preventing a backward operation of an orbiting scroll when the driving unit is operated in the opposite direction of a direction for compressing a fluid or the driving unit is operated in the backward direction due to a load greater than a motor torque.

In order to achieve the above-mentioned object, a scroll compressor in accordance with the present invention includes an orbiting scroll connected to a driving unit through a rotational shaft, having a first key groove at the bottom surface and performing an orbiting operation; a main frame for supporting the orbiting scroll so as to perform the orbiting operation and having a second key groove at the top surface; an oldhams ring arranged between the main frame and the orbiting scroll and having a first oldhams ring key and a second oldhams ring key at the top and bottom surfaces so as to be inserted into the first and second key grooves respectively; and a reversion preventive device installed at the second key groove on the main frame in order to prevent the reverse operation of the orbiting scroll by retraining the movement of the second oldhams ring key in the reverse operation of the orbiting scroll.

The reversion preventive device is installed at a second side surface of the second key groove as the opposite surface of a first side surface at which the second oldhams ring key is contacted in the orbiting operation of the orbiting scroll.

The reversion preventive device includes a sliding groove formed at the second side surface of the second key groove; a pressurizing member inserted into the sliding groove so as to perform a linear motion, project toward the inner portion of the second key groove as a certain length in order to stop the movement of the second oldhams ring key by pressurizing the second side surface of the second oldhams ring key when the orbiting scroll is operated reversely; and an elastic member arranged in the sliding groove and providing a certain elastic force to the pressurizing member.

A width of the second key groove is greater than a width of the second oldhams ring key as a certain degree.

The sliding groove is formed at the second side surface of the second key groove so as to be at right angles and have a certain length.

The pressurizing member is formed as a rod shape so as to have a plane front surface contacted to the second oldhams ring key and have a certain length.

The elastic member is a coil spring.

A scroll compressor in accordance with another embodiment of the present invention includes an orbiting scroll for performing an orbiting operation by being connected to a driving unit through a rotational shaft and having a first key groove; a main frame for supporting the orbiting scroll so as to perform the orbiting operation and having a second key groove; an oldhams ring arranged between the main frame and the orbiting scroll and having a first oldhams ring key and a second oldhams ring key at the top and bottom surfaces so as to be inserted into the first and second key grooves respectively; and a reversion preventive device installed at the first key groove in order to prevent the reverse operation of the orbiting scroll by retraining the movement of the first oldhams ring key in the reverse operation of the orbiting scroll.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

There can be plural embodiments of a scroll compressor having a reversion preventive device in accordance with the present invention, hereinafter the preferred embodiment of a scroll compressor having a reversion preventive device in accordance with the present invention will be described.

Figure 1:
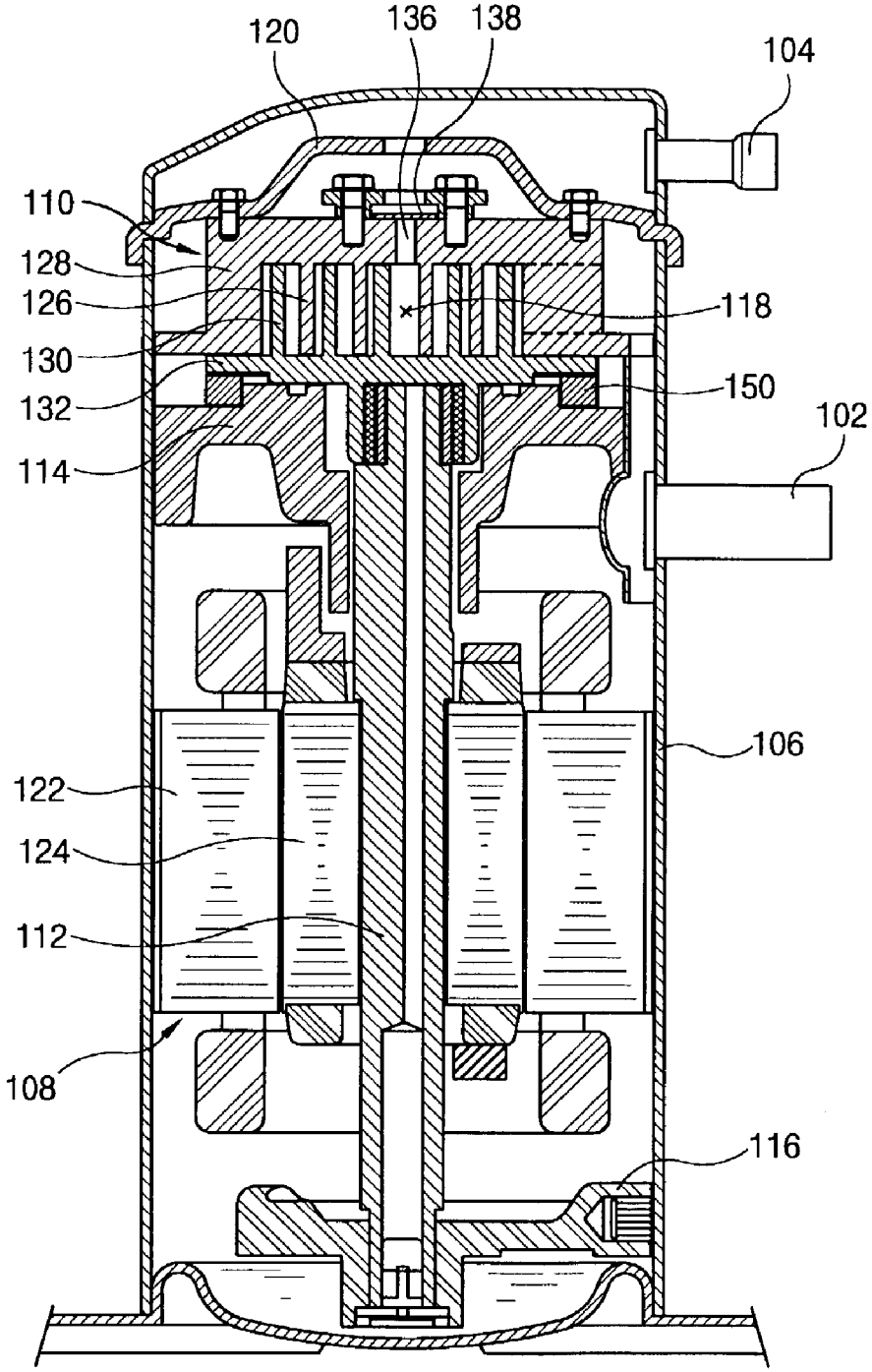
FIG.1 BACKGROUND ART
FIG. 1 is a longitudinal-sectional view illustrating the conventional scroll compressor.
Figure 2:
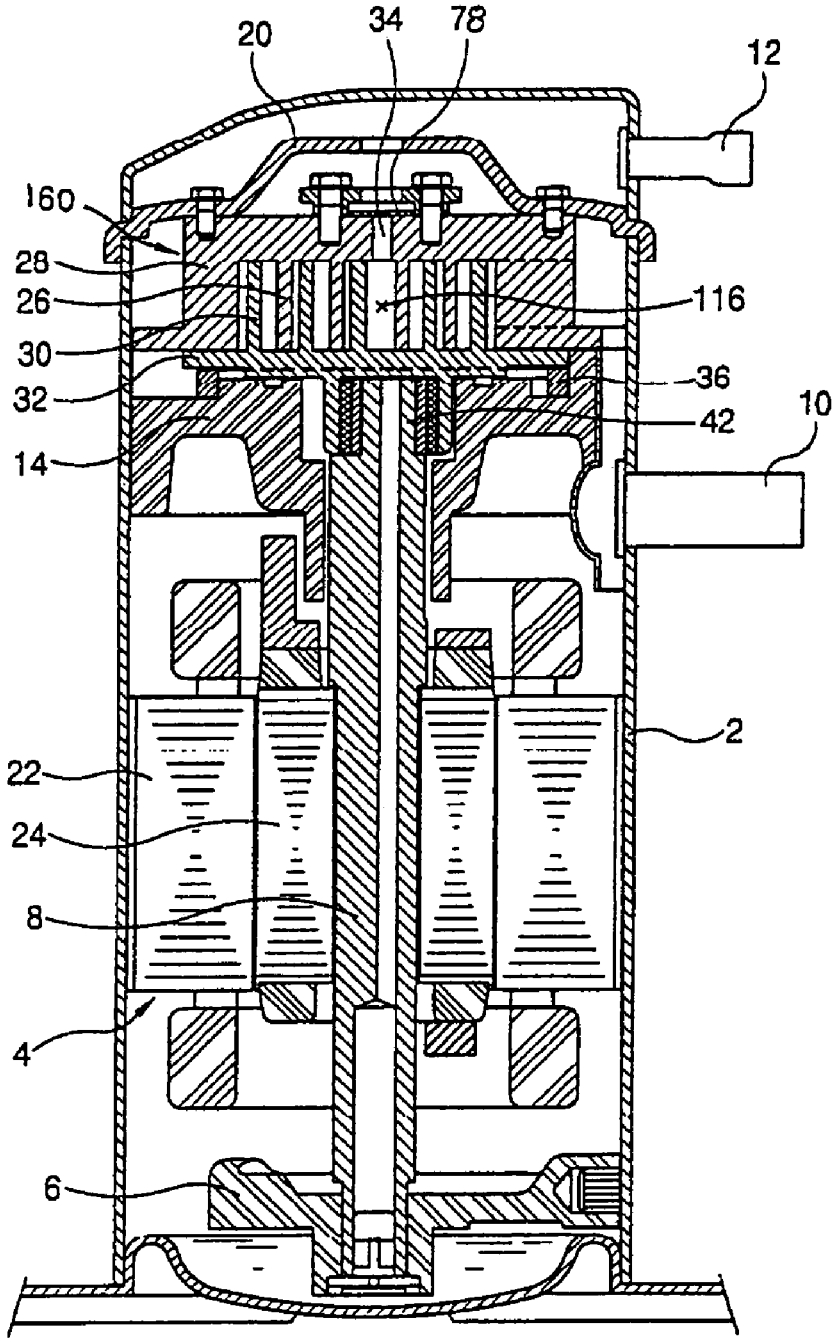
FIG. 2 is a longitudinal-sectional view illustrating a scroll compressor having a reversion preventive device in accordance with the present invention.

FIG. 2 is a longitudinal-sectional view illustrating a scroll compressor having a reversion preventive device in accordance with the present invention.

The scroll compressor in accordance with the present invention includes a casing 2 having a certain sealed space; a driving unit 4 disposed in the casing 2 and generating a driving force; and a compressing unit 160 connected to the driving unit 4 through a rotational shaft 8, compressing a fluid by the driving force of the driving unit 4 and discharging it to the outside.

A suction pipe 10 for sucking a fluid and a discharge pipe 12 for discharging the compressed fluid are respectively connected to a certain side of the casing 2. A main frame 14 is installed in the casing 2 in order to support the upper portion of the rotational shaft 8 rotatively and support the compressing unit 160. A lower frame 6 is installed in the casing 2 in order to support the lower portion of the rotational shaft 8 rotatively. And, a separating plate 20 is installed at the upper portion of the casing 2 in order to divide the inner space of the casing 2 into a high pressure side and a low pressure side.

The driving unit 4 includes a stator 22 fixed to the inner circumference of the casing 2 and a rotor 24 arranged at the inner circumference of the stator 22 and fixed to the rotational shaft 8. When power is applied to the stator 22, the rotor 24 is rotated by the mutual operation of the stator 22, and accordingly the rotational shaft 8 is rotated.

The compressing unit 160 includes a fixed scroll 28 having an involute-shaped fixed wrap 26 and fixed to the upper portion of the casing 2; and an orbiting scroll 32 having an involute-shaped orbiting wrap 30 corresponded to the fixed wrap 26 so as to have a compression space 116 therebetween, supported by the main frame 14 and eccentrically connected to the rotational shaft 8 so as to perform an orbiting operation.

And, an oldhams ring 36 is arranged between the orbiting scroll 32 and the main frame 14 in order to prevent the rotation of the orbiting scroll 32.

A discharge hole 34 at which the fluid compressed by the mutual operation of the fixed wrap 26 and the orbiting wrap 30 is discharged is formed at the center of the fixed scroll 28, and a check valve 78 is installed at the upper portion of the fixed scroll 28 in order to prevent the fluid discharged to the high pressure side from being flowed backward in the low pressure side.

Figure 3:
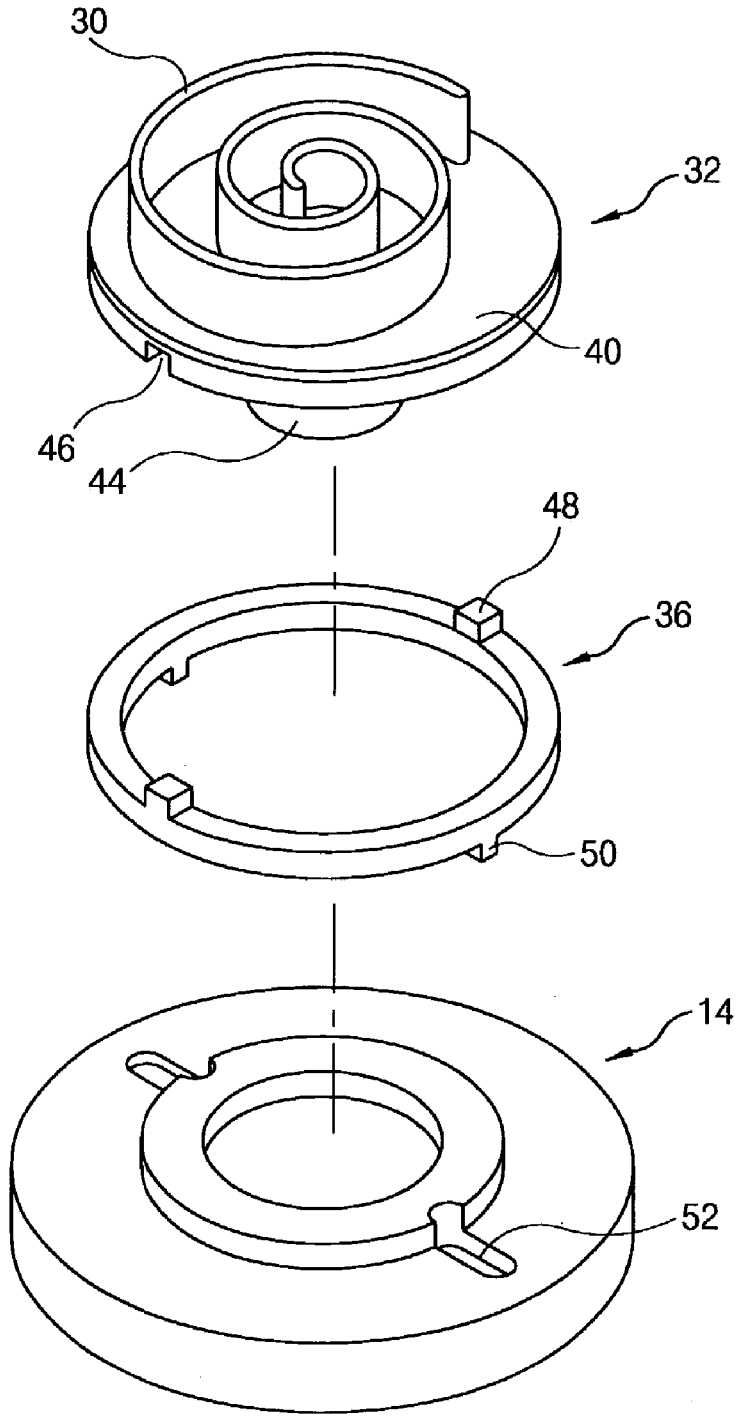
FIG. 3 is an exploded view illustrating an orbiting scroll, an oldhams ring and a main frame of the scroll compressor in accordance with the present invention.

As depicted in FIG. 3, the orbiting scroll 32 includes a disc-shaped base plate 40; the orbiting wrap 30 formed at the top surface of the base plate 40 and a boss 44 formed at the bottom surface of the base plate 40 so as to receive an eccentric portion 42 of the rotational shaft 8. And, a first key groove 46 is respectively formed at the both edges of the base plate 40.

The oldhams ring 36 is a ring having a certain thickness. It has the both plane top and bottom surfaces. A first oldhams ring key 48 is formed at the top surface of the oldhams ring 36 so as to be inserted into the first key groove 46, and a second oldhams ring key 50 is formed at the bottom surface of the oldhams ring 36 at an interval of 90° with the first oldhams ring key 48 so as to be inserted into a second key groove 52 formed at the main frame 14.

In more detail, in the oldhams ring 36, the first oldhams ring key 48 and the second oldhams ring key 50 cross at right angles, and they are respectively inserted into the first key groove 46 of the orbiting scroll 32 and the second key groove 52 of the main frame 14 in order to guide the orbiting operation of the orbiting scroll 32.

Figure 4:
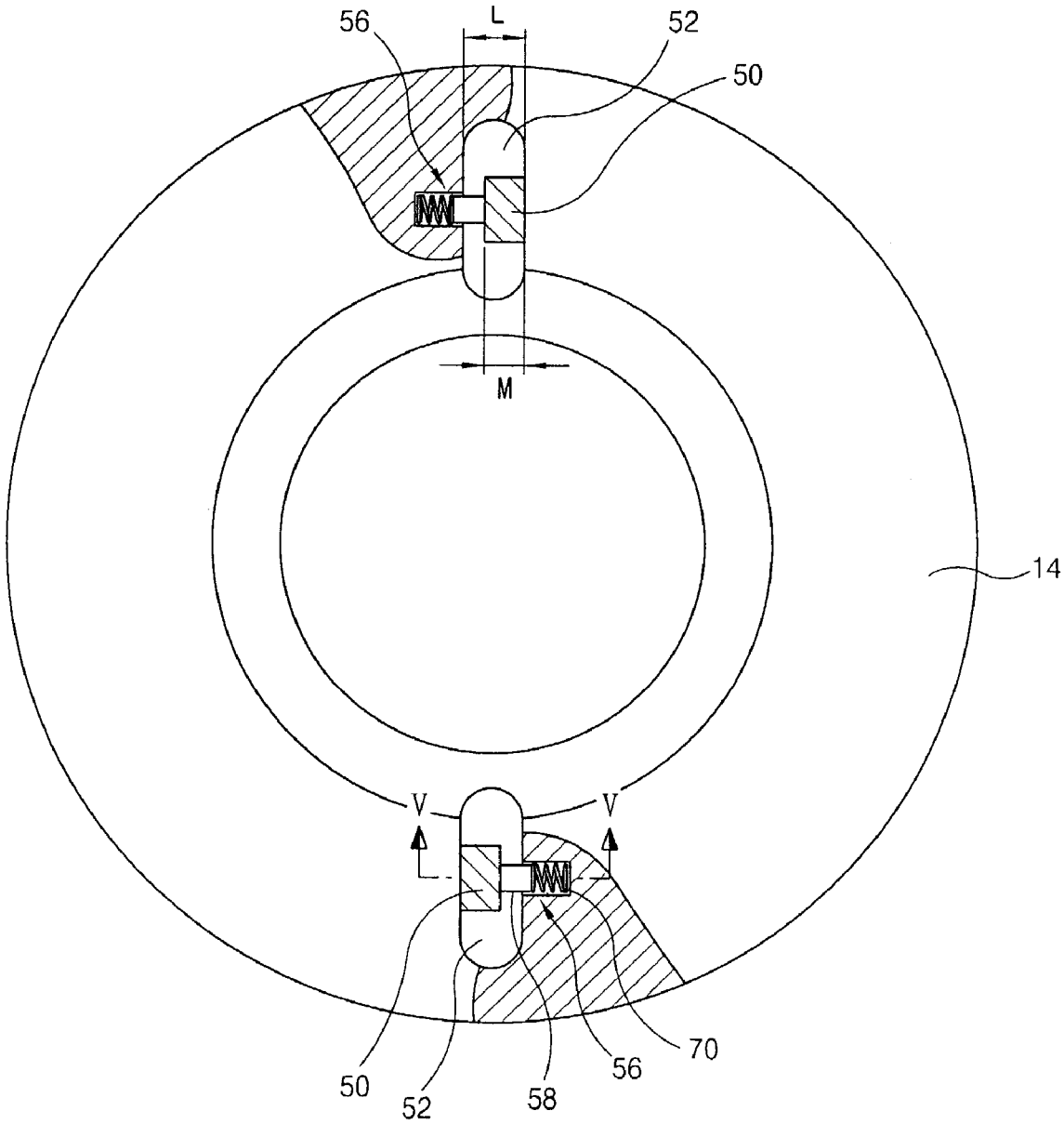
FIG. 4 is a top view illustrating a main frame at which the reversion preventive device in accordance with the present invention is installed.

Herein, as depicted in FIG. 4, in the main frame 14, the rotational shaft 8 is supported rotatively, the second key groove 52 is formed so as to receive the second oldhams ring key 50, and a reversion preventive device 56 is installed at the second key groove 52 in order to prevent the orbiting scroll 32 from being operated reversely.

Herein, in order to make the second oldhams ring key 50 move in the width direction, a width (L) of the second key groove 52 is greater than a width (M) of the second oldhams ring key 50. And, when the orbiting scroll 32 is operated normally, a first side surface 72 of the second oldhams ring key 50 is always contacted-slid into a first side surface 60 of the second key groove 52, when the orbiting scroll 32 is operated reversely, a second side surface 74 of the second oldhams ring key 50 is contacted to a second side surface 62 of the second key groove 52.

Figure 5:
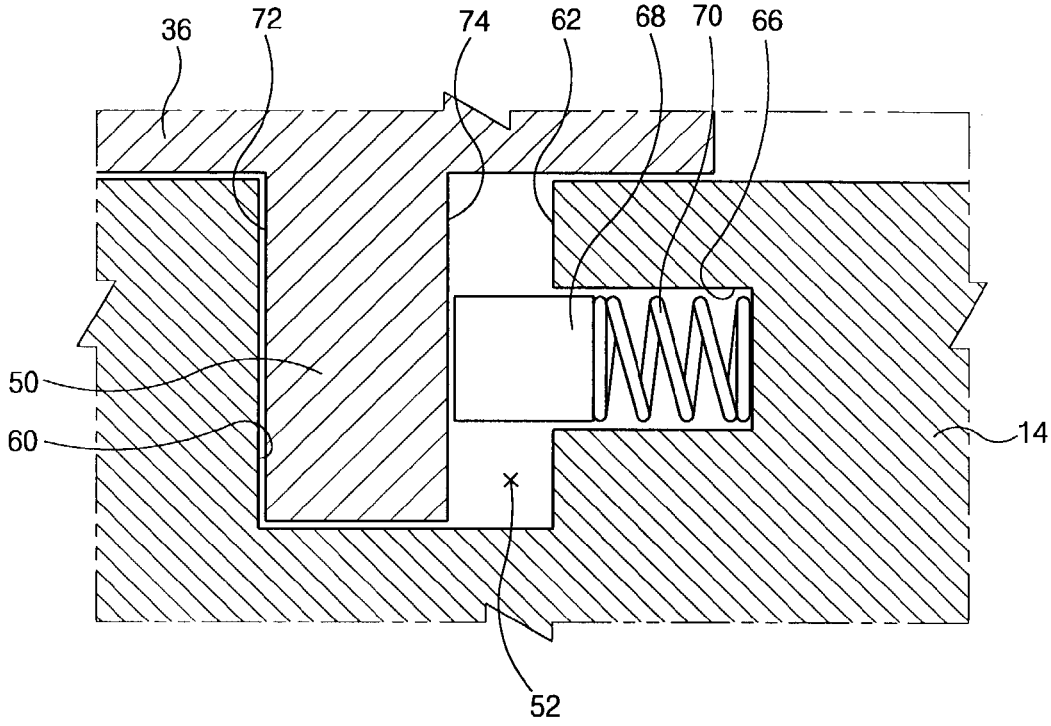
FIG. 5 is a sectional view taken along a line V—V in FIG. 4.

As depicted in FIGS. 4 and 5, the reversion preventive device 56 includes a sliding groove 66 formed at the second side surface 62 of the second key groove 52; a pressurizing member 68 inserted into a sliding groove 66 so as to perform a linear motion, project toward the inner portion of the second key groove 52 as a certain length and place at the other side surface 74 of the second oldhams ring key 50; and an elastic member 70 arranged in the sliding groove 66 to provide a certain elastic force to the pressurizing member 68.

Herein, it is preferable to form a rod-shaped pressurizing member 68 having a plane front surface and a certain length, and it is preferable to form the elastic member 70 as a coil spring.

The operation of the reversion preventive device of the scroll compressor in accordance with the present invention will be described.

Figure 6:
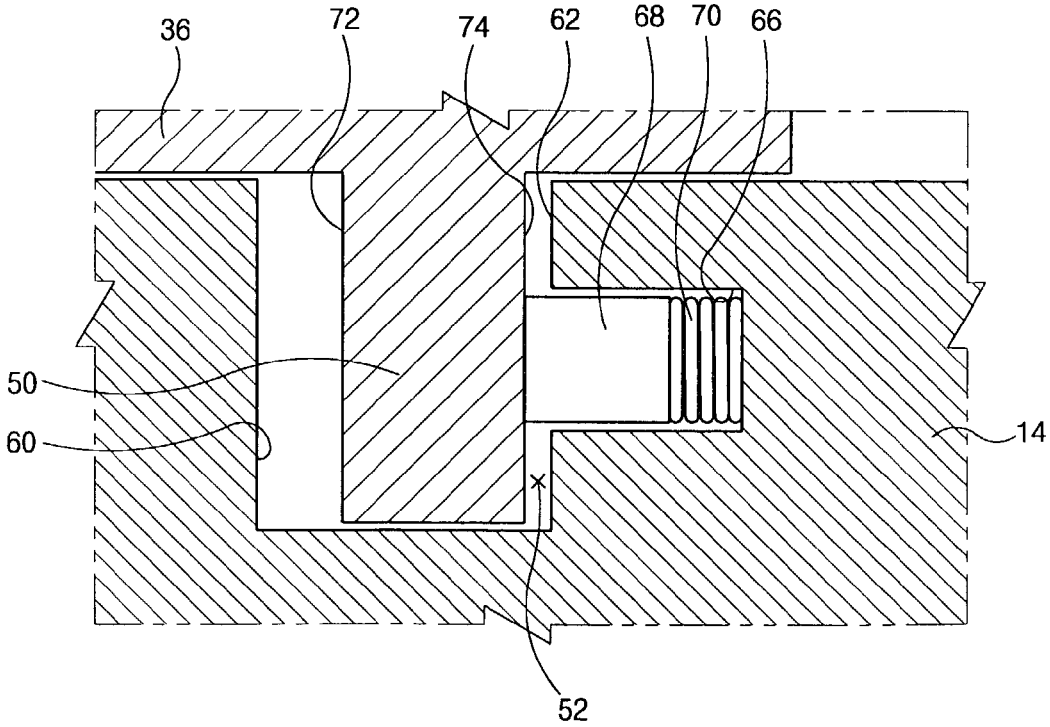
FIG. 6 is a sectional view illustrating an operation of the reversion preventive device.

FIGS. 5 and 6 show the operation state of the reversion preventive device of the scroll compressor in accordance with the present invention.

First, when the driving unit 4 is operated in a direction for compressing the fluid, as depicted in FIG. 5, the orbiting scroll 32 performs the orbiting operation by the rotation of the eccentric portion 42 of the rotational shaft and compresses the fluid with the mutual operation of the fixed scroll 28.

Herein, because the rotation of the orbiting scroll 32 is prevented by the oldhams ring 36, the orbiting scroll 32 performs the orbiting operation. In more detail, when the first oldhams ring key 48 and the second oldhams ring key 50 of the oldhams ring 36 are respectively inserted into the first key groove 46 of the orbiting scroll 32 and the second key groove 52 of the main frame 14 and are slid in the radius direction, the orbiting scroll 32 performs the orbiting operation.

And, if a single-phase motor is used as the driving unit 4, when the motor is rotated reversely due to a load greater than a motor torque or if a three-phase motor is used as the driving unit 4, when the orbiting scroll is operated reversely due to a wrong connection of the motor, it is possible to prevent the orbiting scroll 32 from being operated reversely by the reversion preventive device.

In more detail, as depicted in FIG. 6, by the backward-operation power of the orbiting scroll 32, the second side surface 74 of the second oldhams ring key 50 of the oldhams ring 36 is moved toward the second side surface 62 of the second key groove 52 of the main frame 14. By the movement of the second key groove 52, the second side surface 74 of the second oldhams ring key 50 is tightly contacted to the front surface of the pressurizing member 68, and accordingly the second side surface 62 of the second oldhams ring key 50 is pressurized by the elastic force of the elastic member 70.

Herein, by the elastic force of the elastic member 70, the front surface of the pressurizing member 68 presses the second side surface 74 of the second oldhams ring key 50, and accordingly it is possible to stop the second oldhams ring key 50 from being moved in the radius direction.

As described above, by stopping the movement of the second oldhams ring key 50, it is possible to prevent the orbiting scroll 32 from being operated reversely.

Figure 7:
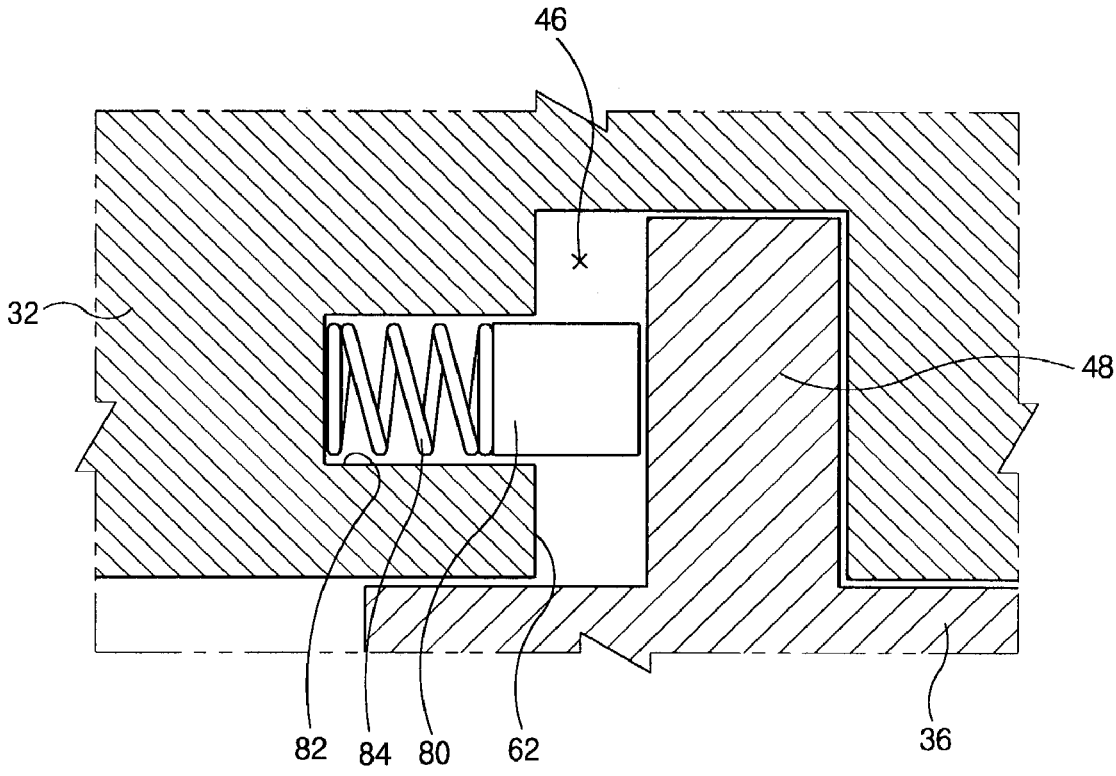
FIG. 7 is a sectional view illustrating a reversion preventive device in accordance with another embodiment of the present invention.

FIG. 7 is a sectional view illustrating a reversion preventive device in accordance with another embodiment of the present invention.

As depicted in FIG. 7, the reversion preventive device in accordance with another embodiment of the present invention includes a sliding groove 82 formed at the first key groove 46 of the orbiting scroll 32; a pressurizing member 80 inserted into the sliding groove 82 so as to perform a linear movement, project toward the inner portion of the first key groove 46 as a certain length and place at the other side surface of the first oldhams ring key 48 of the oldhams ring 36; and an elastic member 84 arranged in the sliding groove 82 and providing a certain elastic force to the pressurizing member 80.

The reversion preventive device in accordance with another embodiment of the present invention has the same construction and operation with that of the embodiment of the present invention, only it is formed at the first key groove 46 on the orbiting scroll 32 in order to prevent the reserve operation of the orbiting scroll 32 by stopping the sliding of the first oldhams ring key 48.

As described above, in the scroll compressor having the reversion preventive device in accordance with the present invention, by installing the reversion preventive device between the orbiting scroll and the oldhams ring or the oldhams ring and the main frame, it is possible to prevent the orbiting scroll from being operated reversely and prevent wrong vibration and noise occurrence of the driving unit, and accordingly reliability of the compressor can be improved.

What is claimed is:

1. A scroll compressor, comprising:

an orbiting scroll connected to a driving unit through a rotational shaft, having a first key groove surrounded by the orbiting scroll and opening into the bottom surface of the orbiting scroll and performing an orbiting operation;

a main frame for supporting the orbiting scroll so as to perform the orbiting operation and having a second key groove at the top surface;

an oldhams ring arranged between the main frame and the orbiting scroll and having a first oldhams ring key and a second oldhams ring key at the top and bottom surfaces so as to be inserted into the first and second key grooves respectively; and a reversion preventive device installed at the second key groove on the main frame in order to prevent the reverse operation of the orbiting scroll by stopping the movement of the second oldhams ring key in the reverse operation of the orbiting scroll.

2. The compressor of claim 1, wherein the reversion preventive device is installed at a second side surface of the second key groove as the opposite surface of a first side surface at which the second oldhams ring key is contacted in the orbiting operation of the orbiting scroll.

3. A scroll compressor, comprising:

an orbiting scroll connected to a driving unit through a rotational shaft, having a first key groove at the bottom surface and performing an orbiting operation;

a main frame for supporting the orbiting scroll so as to perform the orbiting operation and having a second key groove at the top surface;

an oldhams ring arranged between the main frame and the orbiting scroll and having a first oldhams ring key and a second oldhams ring key at the top and bottom surfaces so as to be inserted into the first and second key grooves respectively; and a reversion preventive device installed at the second key groove on the main frame in order to prevent the reverse operation of the orbiting scroll by stopping the movement of the second oldhams ring key in the reverse operation of the orbiting scroll;

wherein the reversion preventive device is installed at a second side surface of the second key groove as the opposite surface of a first side surface at which the second oldhams ring key is contacted in the orbiting operation of the orbiting scroll; and wherein the reversion preventive device includes:

a sliding groove formed at the second side surface of the second key groove;

a pressurizing member inserted into the sliding groove so as to perform a linear motion, project toward the inner portion of the second key groove in order to stop the movement of the second oldhams ring key by pressurizing the second side surface of the second oldhams ring key when the orbiting scroll is operated reversely; and an elastic member arranged in the sliding groove and providing a certain elastic force to the pressurizing member.

4. The compressor of claim 3, wherein a width of the second key groove is greater than a width of the second oldhams ring key.

5. The compressor of claim 3, wherein the sliding groove is formed at the second side surface of the second key groove so as to be at right angles.

6. The compressor of claim 3, wherein the pressurizing member is formed as a rod shape so as to have a plane front surface contacted to the second oldhams ring key.

7. The compressor of claim 3, wherein the elastic member is a coil spring.

8. A scroll compressor, comprising:

an orbiting scroll for performing an orbiting operation by being connected to a driving unit through a rotational shaft and having a first key groove;

a main frame for supporting the orbiting scroll so as to perform the orbiting operation and having a second key groove;

an oldhams ring arranged between the main frame and the orbiting scroll and having a first oldhams ring key and a second oldhams ring key at the top and bottom surfaces so as to be inserted into the first and second key grooves respectively; and a reversion preventive device installed at the first key groove of the orbiting scroll in order to prevent the reverse operation of the orbiting scroll by retraining the movement of the first oldhams ring key in the reverse operation of the orbiting scroll.

9. The compressor of claim 8, wherein the reversion preventive device is installed at the opposite side surface of a side surface of the first key groove at which the first oldhams ring key is contacted in the orbiting operation of the orbiting scroll.

10. The compressor of claim 9, wherein the reversion preventive device includes:

a sliding groove formed at the first key groove of the orbiting scroll;

a pressurizing member inserted into the sliding groove so as to perform a linear motion, project toward the inner portion of the first key groove in order to stop the movement of the first oldhams ring key by pressurizing the side surface of the first oldhams ring key when the orbiting scroll is operated reversely; and an elastic member arranged in the sliding groove and providing a certain elastic force to the pressurizing member.

11. The compressor of claim 10, wherein a width of the first key groove is greater than a width of the first oldhams ring key as a certain degree.

12. The compressor of claim 10, wherein the sliding groove is formed at the side surface of the first key groove so as to be at right angles.

13. The compressor of claim 10, wherein the pressurizing member is formed as a rod shape so as to have a plane front surface contacted to the first oldhams ring key.

14. The compressor of claim 10, wherein the elastic member is a coil spring.

* * * * *